US008152034B2

(12) United States Patent
Chang

(10) Patent No.: US 8,152,034 B2
(45) Date of Patent: Apr. 10, 2012

(54) PAPER CLOTH HANGER

(76) Inventor: Kwisuk Chang, Tujunga, CA (US)

( * ) Notice: Subject to any disclaimer, the term of this patent is extended or adjusted under 35 U.S.C. 154(b) by 328 days.

(21) Appl. No.: 12/431,664

(22) Filed: Apr. 28, 2009

(65) Prior Publication Data

US 2010/0270339 A1 Oct. 28, 2010

(51) Int. Cl.
*A41D 27/22* (2006.01)

(52) U.S. Cl. ..... 223/87; 223/88

(58) Field of Classification Search ..... 223/85, 223/87, 88, DIG. 2, 92
See application file for complete search history.

(56) References Cited

U.S. PATENT DOCUMENTS

| | | | | | |
|---|---|---|---|---|---|
| 2,061,266 | A | * | 11/1936 | Young | 223/87 |
| 2,160,127 | A | * | 5/1939 | Coney | 223/88 |
| 2,160,173 | A | * | 5/1939 | Ruen | 223/92 |
| 2,309,421 | A | * | 1/1943 | Tillery | 223/88 |
| 2,340,033 | A | * | 1/1944 | Young et al. | 223/88 |
| 2,365,655 | A | * | 12/1944 | Young et al. | 223/88 |
| 2,368,348 | A | * | 1/1945 | Coney | 223/88 |
| 2,376,220 | A | * | 5/1945 | Young | 223/88 |
| 2,383,819 | A | * | 8/1945 | Ronning | 223/87 |
| 2,392,022 | A | * | 1/1946 | Young | 223/88 |
| 2,393,074 | A | * | 1/1946 | Thompson et al. | 223/87 |
| 2,643,036 | A | * | 6/1953 | Schiffman | 223/88 |
| 2,829,810 | A | * | 4/1958 | Wilson | 223/88 |
| 3,037,675 | A | * | 6/1962 | Tillery et al. | 223/98 |
| 3,353,727 | A | * | 11/1967 | Tillery et al. | 223/88 |
| 3,733,016 | A | * | 5/1973 | Rood | 223/86 |
| 4,026,446 | A | * | 5/1977 | Kessler | 223/88 |
| 4,040,545 | A | * | 8/1977 | Hill | 223/85 |
| 2006/0065681 | A1 | * | 3/2006 | Yeh et al. | 223/85 |

* cited by examiner

*Primary Examiner* — Nathan Durham
(74) *Attorney, Agent, or Firm* — John K. Park; Park Law Firm

(57) ABSTRACT

A paper cloth hanger is provided. The paper cloth hanger includes a triangular paper loop portion and a paper hook portion. The triangular paper loop portion comprises two tilted bars and a base bar, and the two tilted bars and the base bar meet at a top cusp. The paper hook portion is extended from the top cusp of the triangular paper loop portion. The triangular loop portion and the paper hook portion are formed by paper pulps added with glue. The paper cloth hanger may further include one or more connectors that are made of metal.

9 Claims, 8 Drawing Sheets

PAPER CLOTH HANGER

BACKGROUND OF THE INVENTION

The present invention relates to a paper cloth hanger. More particularly, this invention relates to a cloth hanger, which includes paper portions to reduce manufacturing cost and to facilitate manufacturing.

A cloth hanger is usually made of metal wire such as iron wire.

In some situations, however, metal wire is not desirable to manufacture a cloth hanger with. Metal may be very expensive. Still, it might be challenging to manufacture a cloth hanger with a material other than the metal. With a new material, the traditional cloth hanger needs to be changed in structures and manufacturing method. The new material and manufacturing method must meet the challenging requirement for a cloth hanger.

Accordingly, a need for a paper cloth hanger has been present for a long time considering the amount of usage in the everyday life and resource conservation of persistent worldwide interest. This invention is directed to solve these problems and satisfy the long-felt need.

SUMMARY OF THE INVENTION

The present invention contrives to solve the disadvantages of the prior art.

An objective of the invention is to provide a paper cloth hanger.

Another object of the invention is to provide a cloth hanger, which enables saving material cost and facilitating manufacturing itself.

Still another object of the invention is to provide a paper cloth hanger, which includes paper bar portions and metal wire portions.

An aspect of the invention provides a paper cloth hanger. The paper cloth hanger includes a substantially triangular paper loop portion and a paper hook portion.

The substantially triangular paper loop portion comprises two tilted bars and a base bar, and the two tilted bars and the base bar meet at a top cusp.

The paper hook portion is extended from the top cusp of the triangular paper loop portion.

The triangular loop portion and the paper hook portion are formed by paper pulps added with glue.

Another aspect of the invention provides a paper cloth hanger comprising a substantially triangular paper loop portion and a hook portion.

The substantially triangular paper loop portion comprises two tilted bars and a base bar, and the two tilted bars and the base bar meet at a top cusp.

The hook portion is extended from the top cusp of the triangular paper loop portion, and comprises embedded holding portion configured to be disposed in the triangular loop portion at the top cusp. The embedded holding portion comprises one or more gripping fingers.

The triangular loop portion is formed by paper pulps added with glue, and the gripping fingers of the hook portion are dispersed to hinder the hook portion from slipping out.

The hook portion may be made of metal. The metal may comprise metal wires.

Each of the gripping fingers of the hook portion may comprise a plurality of barbs extending toward back to a direction generally toward the top cusp.

Still another aspect of the invention provide a paper cloth hanger, comprising two tilted bar portions, a base bar portion, a hook portion, a top connector, and two side connectors.

The two tilted bar portions are made of paper, and each of the tilted bar portions comprises a top end and a bottom end.

The base bar portion is made of paper, and comprises two ends.

The hook portion is made of paper, and comprises a bottom end.

The top connector has a shape of a three-leg star, and each of the three legs of the top connector is connected to one of the bottom end of the hook portion and the two top ends of the two tilted bar portions.

Each of the two side connectors has a shape of V comprising two legs, and each of the side connectors connects one of the two tilted bar portions with a corresponding one of the two side ends of the base bar portion.

The tilted bar portions, the base bar portions, and the hook portion are formed by paper pulps added with glue, and the top connector and the two side connectors are made of metal.

Each of the connectors may comprise one or more embedded holding portions. The embedded holding portion may comprise one or more gripping fingers. Each of the gripping fingers of the hook portion may comprise a plurality of barbs extending toward back to a direction generally toward the top cusp, and ends of the gripping fingers of the hook portion may be dispersed to hinder the hook portion from slipping out.

The base bar portion may comprise a core wire extended between the two side ends.

The core wire may be integrated with the two side connectors.

Alternatively, the core wire may have a square cross-section.

The core wire may have a rectangular cross-section, and a long side of the rectangular cross-section may be aligned along a line connecting top and bottom direction.

The core wire may have an oval cross-section, and a long axis of the oval shape may be aligned along a line connecting top and bottom direction.

The paper cloth hanger may further comprise a film of paint over at least part of the surface of the paper cloth hanger.

Each of the tilted bar portions may comprise a core wire. The core wires of the tilted bar portions may be connected to the core wire of the base bar portion to form a triangle.

Still another aspect of the invention provide a method for manufacturing the paper cloth hanger.

The method comprises: providing a mold for the paper cloth hanger; providing a paper pulp; pouring the paper pulp into the mold; drying the paper pulp in the mold in shade; and removing the mold.

The step of providing a paper pulp may comprise: providing water at a predetermined temperature; cutting papers in small pieces; adding glue of a predetermined amount to the water; and adding the paper pieces to a mixture of the water and the glue.

The method may further comprise: painting the paper cloth hanger after drying; and vanishing over the paper cloth hanger.

The advantages of the present invention are: (1) the paper cloth hanger can reduce the usage of metal in manufacturing the hanger; and (2) the paper cloth hanger can be strengthened by metal connectors.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
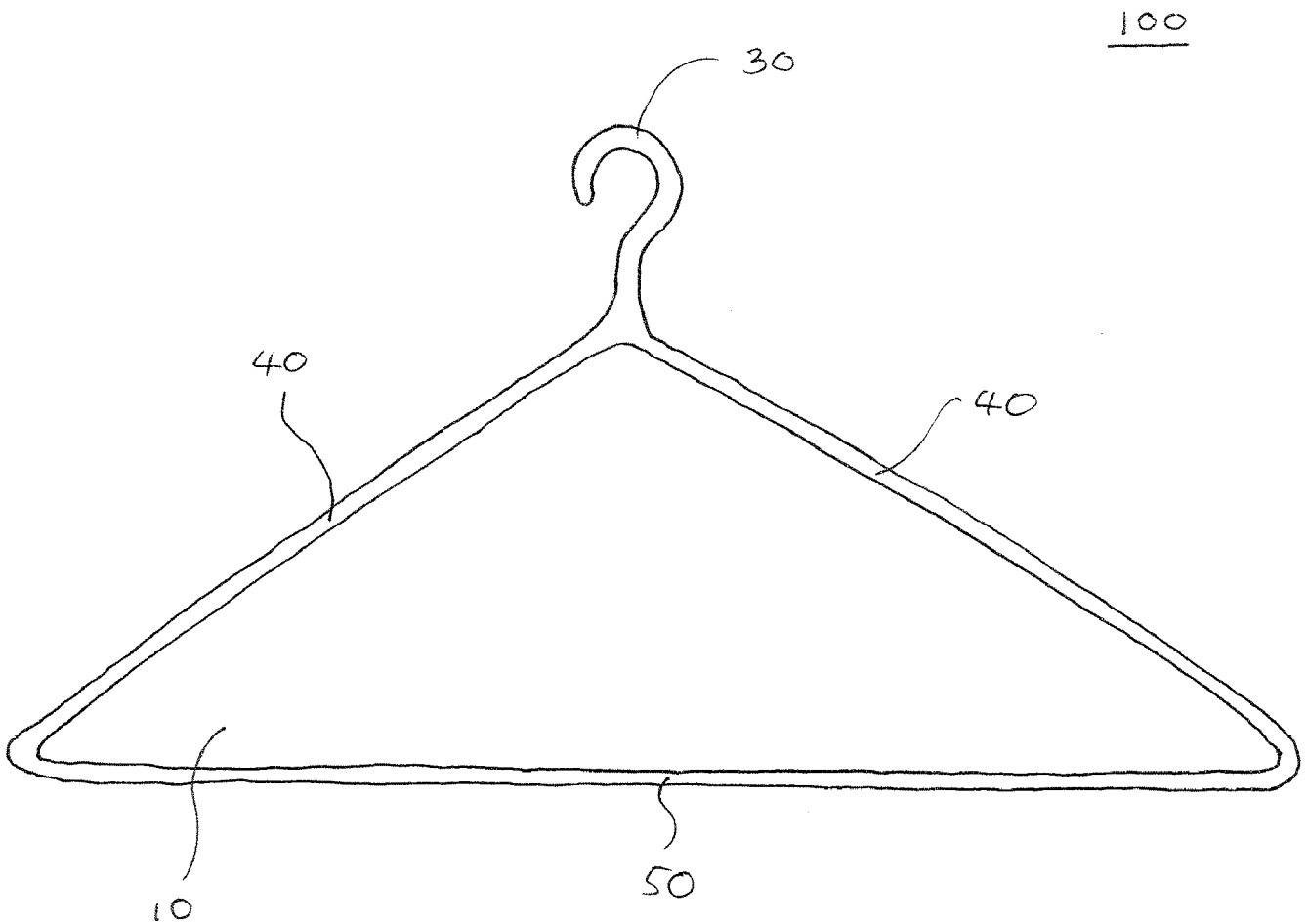
FIG. 1 is a perspective view showing a paper cloth hanger according to an embodiment of the present invention.
Figure 2:
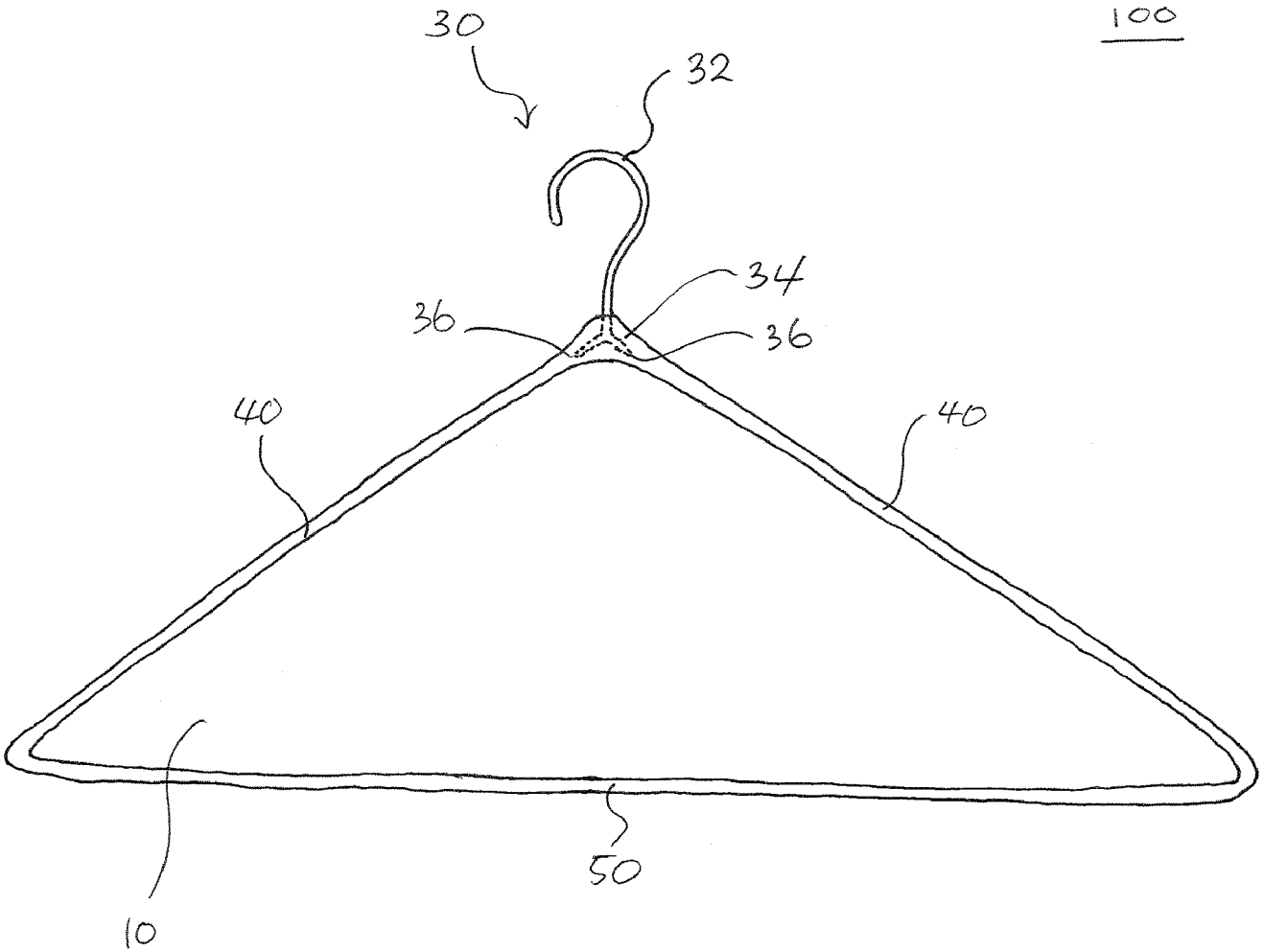
FIG. 2 is a perspective view of a paper cloth hanger according to another embodiment of the present invention.
Figure 3:
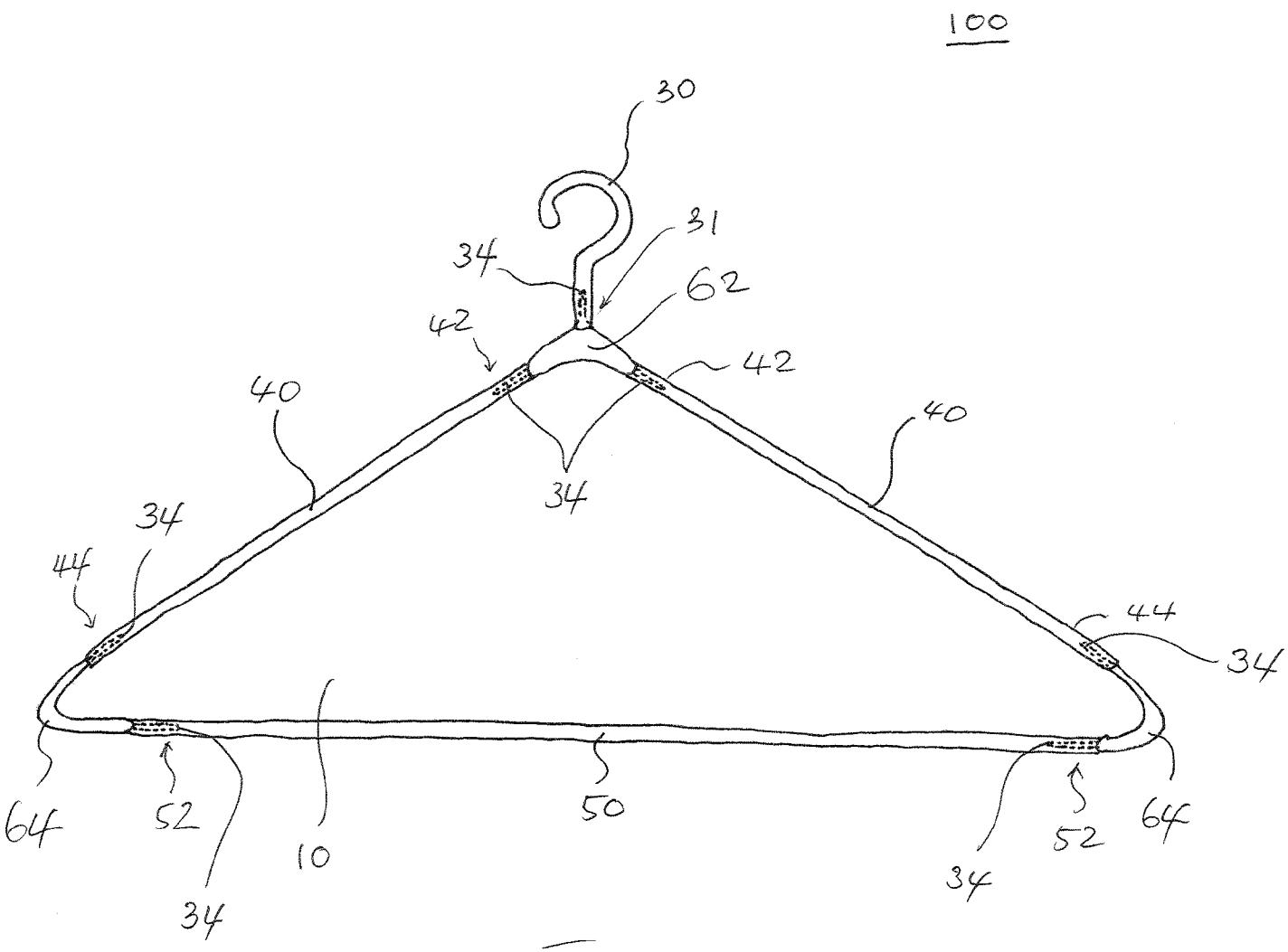
FIG. 3 is a perspective view of a paper cloth hanger according to still another embodiment of the present invention.

FIGS. 1-3 show a paper hanger 100 according to an embodiment of the present invention.

An aspect of the invention provides the paper cloth hanger 100 as shown in FIG. 1. The paper cloth hanger 100 includes a substantially triangular paper loop portion 10 and a paper hook portion 30.

The substantially triangular paper loop portion 10 comprises two tilted bars 40 and a base bar 50, and the two tilted bars 40 and the base bar 50 meet at a top cusp as shown in FIG. 1.

The paper hook portion 100 is extended from the top cusp of the triangular paper loop portion 10.

The triangular loop portion 10 and the paper hook portion 30 are formed by paper pulps added with glue.

Another aspect of the invention provides a paper cloth hanger 100 comprising a substantially triangular paper loop portion 10 and a hook portion 30 as shown in FIG. 2.

The substantially triangular paper loop portion 10 comprises two tilted bars 40 and a base bar 50, and the two tilted bars 40 and the base bar 50 meet at a top cusp as shown in FIG. 2.

The hook portion 30 is extended from the top cusp of the triangular paper loop portion 10, and comprises embedded holding portion 34 configured to be disposed in the triangular loop portion 10 at the top cusp. The embedded holding portion 34 comprises one or more gripping fingers 36 as shown in FIG. 2.

The triangular loop portion 10 is formed by paper pulps added with glue, and the gripping fingers 36 of the hook portion 30 are dispersed to hinder the hook portion 30 from slipping out.

The hook portion 30 may be made of metal. The metal may comprise metal wires. The hook portion 30 may comprise a hook 32 and the embedded holding portion 34 as shown in FIG. 2.

Figure 8:
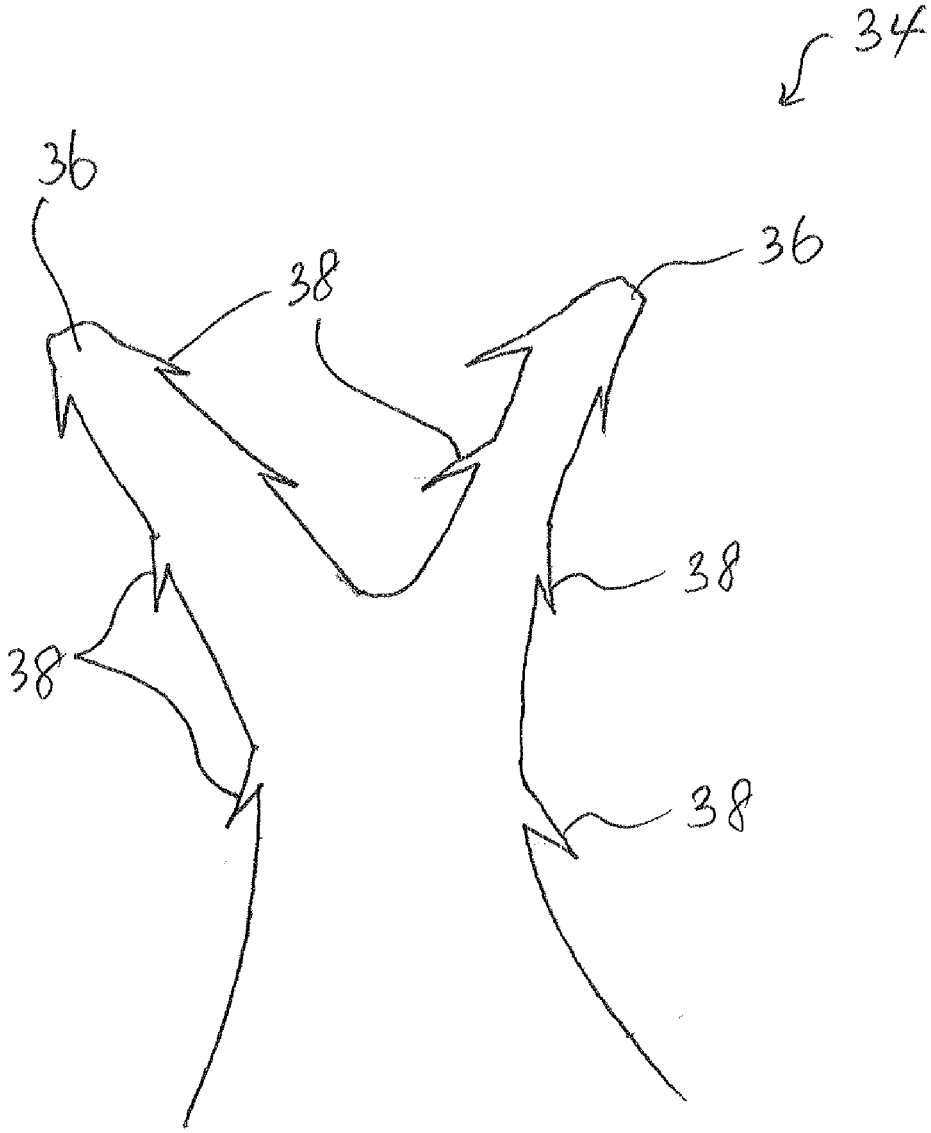
FIG. 8 is an enlarged view of a gripping hand with hook portions according to an embodiment of the invention.

Each of the gripping fingers 36 of the hook portion 30 may comprise a plurality of barbs 38 extending toward back to a direction generally toward the top cusp as shown in FIG. 8.

Still another aspect of the invention provide a paper cloth hanger 100, comprising two tilted bar portions 40, a base bar portion 50, a hook portion 30, a top connector 62, and two side connectors 64 as shown in FIG. 3.

The two tilted bar portions 40 are made of paper, and each of the tilted bar portions 40 comprises a top end 42 and a bottom end 44 as shown in FIG. 3.

The base bar portion 50 is made of paper, and comprises two ends 52.

The hook portion 30 is made of paper, and comprises a bottom end 31.

The top connector 62 has a shape of a three-leg star, and each of the three legs of the top connector 60 is connected to the bottom end 31 of the hook portion 30 and the two top ends 42 of the two tilted bar portions 40.

Each of the two side connectors 64 has a shape of V comprising two legs, and each of the side connectors 64 connects one of the two tilted bar portions 40 with a corresponding one of the two side ends 52 of the base bar portion 50 as shown in FIG. 3.

The tilted bar portions 40, the base bar portions 50, and the hook portion 30 are formed by paper pulps added with glue, and the top connector 62 and the two side connectors 64 are made of metal.

Figure 7:
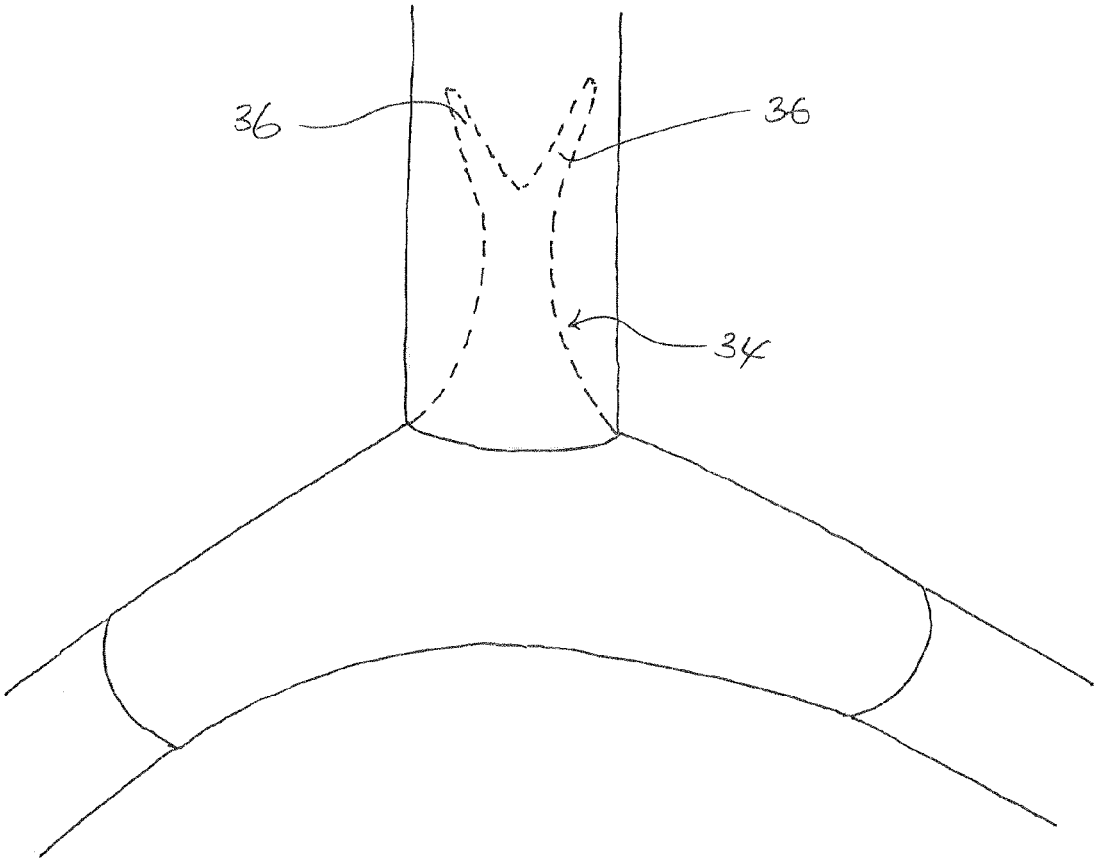
FIG. 7 is an enlarged view showing a gripping hand portion according to an embodiment of the invention.

Each of the connectors 62, 64 may comprise one or more embedded holding portions 34. The embedded holding portion 34 may comprise one or more gripping fingers 36 as shown in FIG. 7. Each of the gripping fingers 36 of the hook portion 34 may comprise a plurality of barbs 38 extending toward back to a direction generally toward the top cusp, and ends of the gripping fingers 38 of the hook portion 34 may be dispersed to hinder the hook portion 34 from slipping out.

Figure 9:
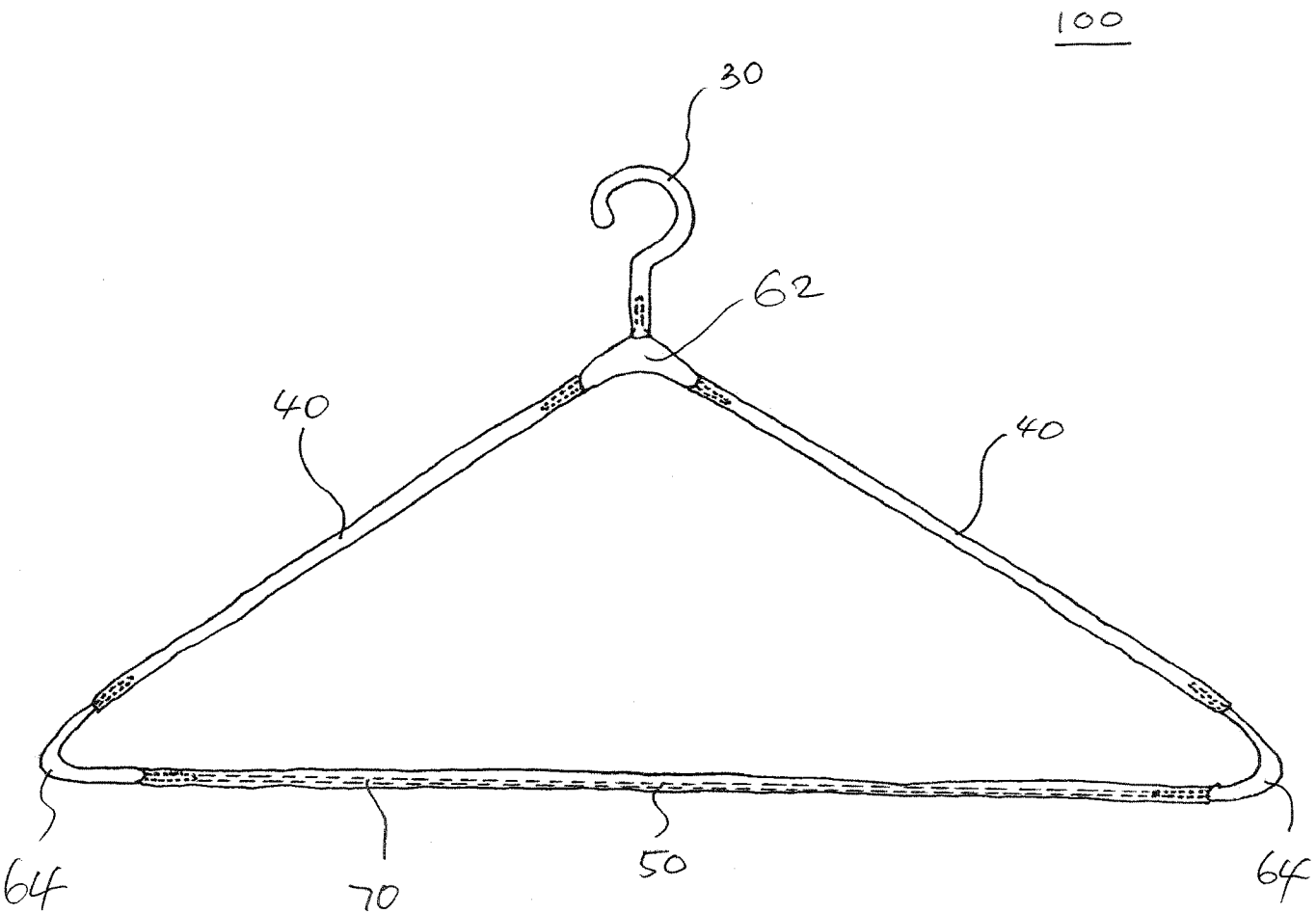
FIG. 9 is a perspective view of a paper cloth hanger having a core wire in the base bar portion according to an embodiment of the invention.

The base bar portion 50 may comprise a core wire 70 extended between the two side ends 52 as shown in FIG. 9.

The core wire 70 may be integrated with the two side connectors 64.

Figure 4:
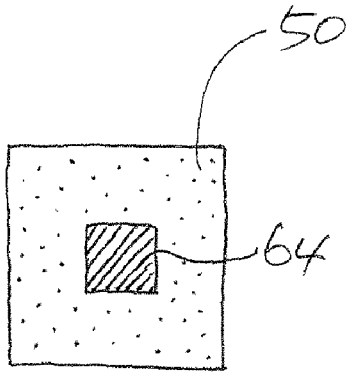
FIG. 4 is a cross-sectional view showing a metal connector in a paper portion according to an embodiment of the invention.

The core wire 70 may have a square cross-section as shown in FIG. 4.

Figure 5:
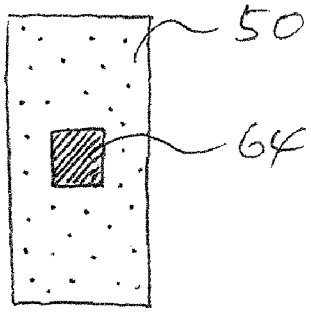
FIG. 5 is a cross-sectional view showing a metal connector in a paper portion according to another embodiment of the invention.

Alternatively, the core wire 70 may have a rectangular cross-section as shown in FIG. 5, and a long side of the rectangular cross-section may be aligned along a line connecting top and bottom direction.

Figure 6:
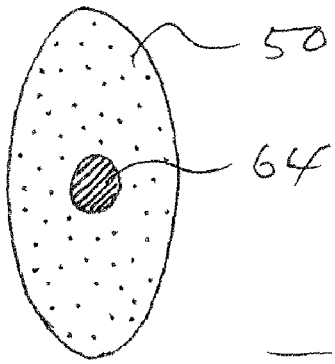
FIG. 6 is a cross-sectional view showing a metal connector in a paper portion according to still another embodiment of the invention.

Alternatively, the core wire 70 may have an oval cross-section as shown in FIG. 6, and a long axis of the oval shape may be aligned along a line connecting top and bottom direction.

The paper cloth hanger 100 may further comprise a film of paint over at least part of the surface of the paper cloth hanger 100.

Each of the tilted bar portions 40 may comprise a core wire 70 (not shown, but similar to 70 in FIG. 3) as in the base bar portions 50. The core wires 70 of the tilted bar portions 40 may be connected to the core wire 70 of the base bar portion 50 to form a triangle. In these embodiments, the connectors 62, 64 do not have to include the hook portions 34.

Still another aspect of the invention provides a method for manufacturing the paper cloth hanger.

Figure 10:
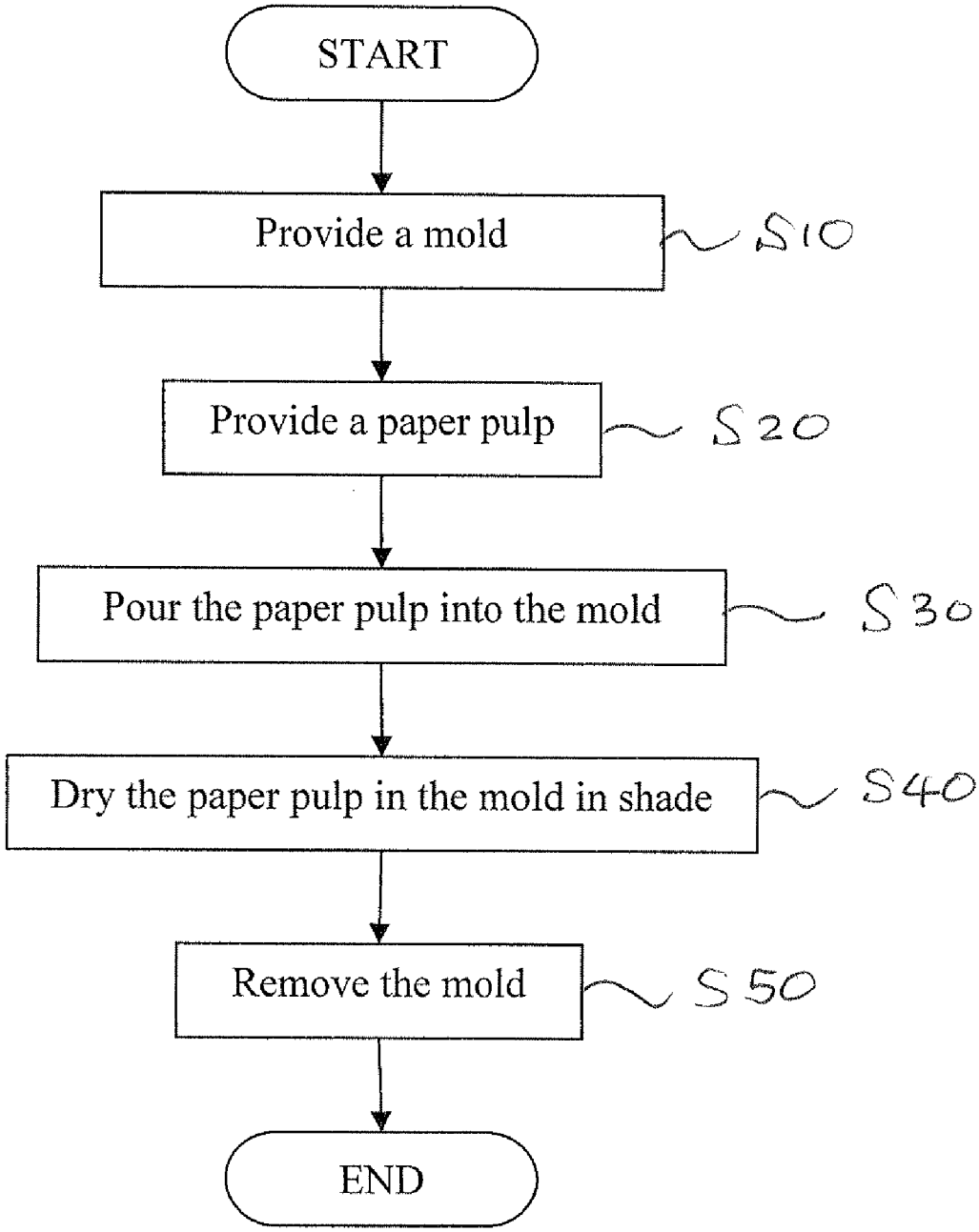
FIG. 10 is a flowchart illustrating a manufacturing method of a paper cloth hanger according to an embodiment of the invention.

The method comprises: providing a mold for the paper cloth hanger S10; providing a paper pulp S20; pouring the paper pulp into the mold S30; drying the paper pulp in the mold in shade S40; and removing the mold S50 as shown in FIG. 10.

The step of providing a paper pulp S20 may comprise: providing water at a predetermined temperature; cutting papers in small pieces; adding glue of a predetermined amount to the water; and adding the paper pieces to a mixture of the water and the glue.

The method may further comprise: painting the paper cloth hanger after drying; and vanishing over the paper cloth hanger.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A paper cloth hanger, comprising:

two tilted bar portions, each of which made of paper, wherein each of the tilted bar portions comprises a top end and a bottom end;

a base bar portion made of paper, comprising two ends;

a hook portion made of paper, comprising a bottom end;

a top connector having a shape of a three-leg star, wherein each of the three legs of the top connector is connected to one of the bottom end of the hook portion and the two top ends of the two tilted bar portions;

two side connectors, each of which having a shape of V, comprising two legs, wherein each of the side connectors connects one of the two tilted bar portions with a corresponding one of the two side ends of the base bar portion, wherein the tilted bar portions, the base bar portions, and the hook portion are formed by paper pulps added with glue, and wherein the top connector and the two side connectors are made of metal, wherein each of the connectors comprises one or more embedded holding portions, wherein the embedded holding portion comprises one or more gripping fingers, wherein each of the gripping fingers of the hook portion comprises a plurality of barbs extending toward back to a direction generally toward a top cusp, and wherein the gripping fingers of the hook portion are dispersed to hinder the hook portion from slipping out, wherein the tilted bar portions and the base bar portion are solid without hollow therein, and wherein the gripping fingers are embedded into sides of the tilted bar portions or the base bar portion.

2. The paper cloth hanger of claim 1, wherein the base bar portion comprises a core wire extended between the two side ends.

3. The paper cloth hanger of claim 2, wherein the core wire is integrated with the two side connectors.

4. The paper cloth hanger of claim 2, wherein the core wire has a square cross-section.

5. The paper cloth hanger of claim 2, wherein the core wire has a rectangular cross-section, and wherein a long side of the rectangular cross-section is aligned along a line connecting top and bottom direction.

6. The paper cloth hanger of claim 2, wherein the core wire has an oval cross-section, and wherein a long axis of the oval shape is aligned along a line connecting top and bottom direction.

7. The paper cloth hanger of claim 1, further comprising a film of paint over at least part of the surface of the paper cloth hanger.

8. The paper cloth hanger of claim 1, wherein each of the tilted bar portions comprises a core wire.

9. The paper cloth hanger of claim 8, wherein the core wires of the tilted bar portions are connected to a core wire of the base bar portion to form a triangle.

* * * * *